US005706607A

United States Patent [19]

Frey

[11] Patent Number: 5,706,607

[45] Date of Patent: Jan. 13, 1998

[54] MAGNETIC DOOR SEAL

[76] Inventor: Harry Frey, 87600 Oberbeuren, Kaufbeuren, Germany

[21] Appl. No.: 529,912

[22] Filed: Sep. 18, 1995

[30] Foreign Application Priority Data

Sep. 17, 1994 [DE] Germany ..... 44 33 145.2

[51] Int. Cl.[6] ..... E06B 7/16

[52] U.S. Cl. ..... 49/478.1; 49/469

[58] Field of Search ..... 49/469, 471, 478.1, 49/476.1, 489.1, 492.1, 490.1

[56] References Cited

U.S. PATENT DOCUMENTS

| | | | |
|---|---|---|---|
| 3,077,644 | 2/1963 | Kesling | 49/478.1 |
| 4,309,680 | 1/1982 | Kiel | 49/478.1 |
| 4,480,407 | 11/1984 | Needham et al. | 49/478.1 |
| 4,831,779 | 5/1989 | Kehrli et al. | 49/469 |
| 4,945,680 | 8/1990 | Giguere | 49/468 |

FOREIGN PATENT DOCUMENTS

| | | |
|---|---|---|
| 0451732B1 | 5/1991 | European Pat. Off. . |
| 0568949A1 | 3/1993 | European Pat. Off. . |

*Primary Examiner*—Blair Johnson
*Assistant Examiner*—Curtis Cohen
*Attorney, Agent, or Firm*—Jacobson, Price, Holman & Stern, PLLC

[57] ABSTRACT

A magnetic door seal for use in association with a door mounted above a threshold, in which the lower edge (18) of the door carries a first profile (1) and a second profile (3) is provided on the threshold. The two profiles (1,3) each receive a magnetic strip (51,53). One magnetic strip (53) is movable and acts as a sealing strip, while the other magnetic strip (51) cooperates magnetically with the first magnetic strip in order to seal the gap (5) between the lower edge of the door and the threshold when the door is closed. The magnetic strip (53) which is arranged in the second profile (3) at least partially defines a water drainage channel (303) extending parallel to the magnetic strip.

17 Claims, 5 Drawing Sheets

MAGNETIC DOOR SEAL

BACKGROUND TO THE INVENTION

1. Technical Field of the Invention

The invention concerns a magnetic door seal, in particular to a magnetic door seal in which the lower edge of the door leaf carries a first profile and a second profile is provided on the floor, the two profiles each receiving a magnetic strip, one of the magnetic strips being movable and acting as a sealing strip, while the other magnetic strip cooperates magnetically with the first magnetic strip in order to seal the gap between the lower edge of the door and the threshold when the door is closed.

2. Description of the Prior Art

EP-A-0 568 949 discloses a magnetic door seal. The threshold includes a vertically displaceable magnetic strip which cooperates with a corresponding magnetic counterpart on the lower side of the door in such a way that the magnetically movable portion is pulled upwards and seals the gap when the door is closed. The magnetic strip which is mounted on the lower side of the door is provided with a recess which engages in a corresponding groove at the lower edge of the door. A laterial opening is provided in the threshold profile for drainage of water.

In this door seal, it is a disadvantage that water which penetrates into the guide of the magnetic strip is drained away only at the side. If this drainage is blocked or the water cannot drain away in the foundation of the threshold, then the accumulating water can penetrate to the inside of the threshold.

It is an object of the present invention to develop known magnetic door sealing assemblies further so that water (rainwater or the like) which penetrates to the region of the door seal is reliably collected and drained away.

BRIEF SUMMARY OF THE INVENTION

To achieve the object according to the invention, the invention starts from a magnetic door seal of the kind described above. The invention proposes that one magnetic strip, which is arranged in the second profile, at least partially defines a water drainage channel extending parallel to the magnetic strip. This drainage channel is provided over the whole width of the threshold profile. As a result, reliable conduction of water which has penetrated into the recess receiving the magnetic strip is achieved. The water is collected and can be conducted to any location, in order from there to be conducted away from the threshold. The water, for example, driving rain, melt water or the like, enters the recess from the outside through a gap between the magnetic strip and the threshold profile. This inlet opening into the water drainage channel is now located, for example, in front of the outer surface of the movable magnetic strip. When the door is closed, the penetrating water will run off the outer surface of this magnetic strip, which is sealed by the movable magnetic strip, and so enter the water drainage channel. However, it is also possible for this penetrating water to be conducted into a water drainage channel which is arranged behind the outer surface of the movable magnetic strip. For example, the water drainage channel can be provided under the magnetic strip.

SUMMARY OF THE INVENTION

It is favourable if a recess is arranged in the second profile on the floor, in which recess the movable magnetic strip is provided, and that this recess serves as the water drainage channel, with water run-off openings into a collecting channel. Due to the movable magnetic strips arranged at the bottom in the recess, the contact surfaces of the two magnetic strips are located close to the lower edge of the door. Penetration of driving rain at this point is very unlikely. It is also possible for the movably arranged magnetic strip to be arranged in the first profile, and for the fixed magnetic strip to define the water drainage channel. Due to the arrangement of an additional collecting channel, the capacity of the water drainage channel is still further increased, as the water is conducted through a plurality of water run-off openings out of the water drainage channel and into a collecting channel which is spatially separate from the recess. The water run-off openings are provided along the water drainage channel. In this case it is favourable if this collecting channel is also designed as a profile portion of the threshold profile and can be connected thereto. The profiles are in this case made of aluminium, for example, and constructed as extruded profiles. It is also possible for some portions of the profile to be made, for example, of plastic.

Furthermore it is advantageous if parallel to each other there are provided two recesses which each receive a magnetic strip and form water drainage channels, and which both have water run-off openings which lead to a collecting channel. As a result, reliable sealing of the interior from the exterior is achieved even if due to any circumstances the water drainage channel of the outer recess (for example, because the latter is blocked) can no longer receive the water and so the water penetrates into the gap between the two recesses. A second magnetic sealing strip which defines a water drainage channel is provided for this purpose. The water which has penetrated here is then also drained away through water run-off openings into a common collecting channel provided along the threshold profile.

Also it is favourable if the collecting channel comprises lateral covers for draining the channel on the outside of the threshold. This cover comprises, for example, a connection piece on which is fitted a hose of any length which conducts away from the threshold the water supplied from the collecting channel and ends at any point, for example outside the foundation of the threshold. Hence the water is reliably drained away from the region of the threshold.

Furthermore it is favourable if the threshold profile comprises a flat surface. In particular it is provided here that the threshold profile does not form any steps which can be crossed only with difficulty by prams or trolleys. Ideally, shoulders are absent, or the shoulders are made so small in relation to the diameter of the wheels that these shoulders are not a hindrance. At the same time, due to the arrangement of the water drainage channel in the profile it is ensured that the water impinging on the threshold does not pass into the interior. Known thresholds comprise a raised portion by which of course the penetration of water is prevented, but these thresholds can be crossed only with great difficulty.

Furthermore it is favourable if the profile is in two portions and the two profile portions are held by an insulating strip and the two profile portions form a recess receiving the magnetic strip. Manufacture of the profile from two or more portions means a reduction in manufacturing expenditure. Also it is possible to produce a large number of different threshold shapes by a small number of different profile types for the outside or inside. In particular, there arises the advantage that a recess which receives the magnetic strip is formed in the region in which the two profile portions butt against each other. Both the movable and the fixed magnetic strips can be provided in this recess. Due to the insulating strip, the metal thermal bridge at the threshold between the inside and outside of a building is interrupted. At the same time the insulating strip accomplishes damping of the sound of footsteps. This insulating strip may be formed, for example, from plastic, carbon fibre-reinforced plastic, plastic-coated metal strip or the like. It is an advantage if a material which exhibits poor thermal conductivity is used.

It has been found that it is advantageous if two essentially E-shaped insulating strips connect the two profile portions and a gap between the two insulating strips is filled with foam, for example, with tool foam or insulating foam. In particular, a profile consisting of two profile portions, which is fixed to the lower side of the door, may be designed in such a way that assembly, even subsequent assembly on a door, can easily be performed. As the two profile portions are separated from each other, the insulating strip can be designed in such a way that it holds the two profile portions together. Hence it is possible to fix only one profile portion with fixing means, for example screws, to the lower edge of the door or to the floor. The other profile portion is held with the aid of the insulating strips.

It is favourable if on the outside of the threshold profile there is provided an L-shaped cover plate which is provided with length-adjusting ribs and which supports an insulating tape. For example, the magnetic door seal according to the invention may be fixed to the door jamb in a shell even before laying the screed. In order that, on the outside, water on the concrete floor below the threshold is reliably prevented from entering the interior, it is provided that a cover plate is provided which supports an insulating tape which causes water which has entered at the threshold profile to be drained away from the threshold to the outside. The cover plate here comprises length-adjusting ribs which allow the lengths of the arms of the cover plate to be shortened as desired and so high variability of the threshold profile to be ensured during installation. The screed resting on the insulating tape then presses it against the cover plate and is supported by the latter. The insulating tape simultaneously also accomplishes damping of footsteps and sound.

Further the invention provides that the threshold profile rests on the floor. Thus it is possible for the threshold profile to be fitted subsequently in existing doorways and for the advantages according to the invention to be utilised. The floor may, for example, be formed by carpets or tiles or the like laid on the screed. As smooth as possible a surface is desirable, so that the threshold profile can easily be crossed. In the threshold profile there is again provided a water drainage channel which receives and drains away the water which has run off the magnetic strip. The threshold profile may be fixed by bolts, for example.

It is favourable if the magnetic strip comprises a seal which seals a contact surface between the first and second magnetic strips. Due to such a design according to the invention, certain dimensional tolerances and inaccuracies in manufacture and laying of the magnetic strip can be allowed without these inaccuracies leading to leaking of the magnetic strip. By design of the seal as, for example, a sealing lip or the like, possible gaps are sealed reliably. Hence it is impossible for water or draughts to penetrate.

Also it is advantageous if the second profile for fixing the profile to a door jamb comprises longitudinally extending screw channels. The door jambs receive the door surround or the door. The jambs are open in the lower region of the threshold. At the ends of the jamb extends the threshold. For common support, it is favourable that the second profile laid in the floor is suitably connected to the door jamb. For this purpose it is provided that screws engage through the door jamb in longitudinally extending screw channels of the profile. Thus a reliably firm, frame-like connection of door jamb and threshold is produced.

DETAILED DESCRIPTION OF PREFERRED EMBODIMENTS

Figure 1:
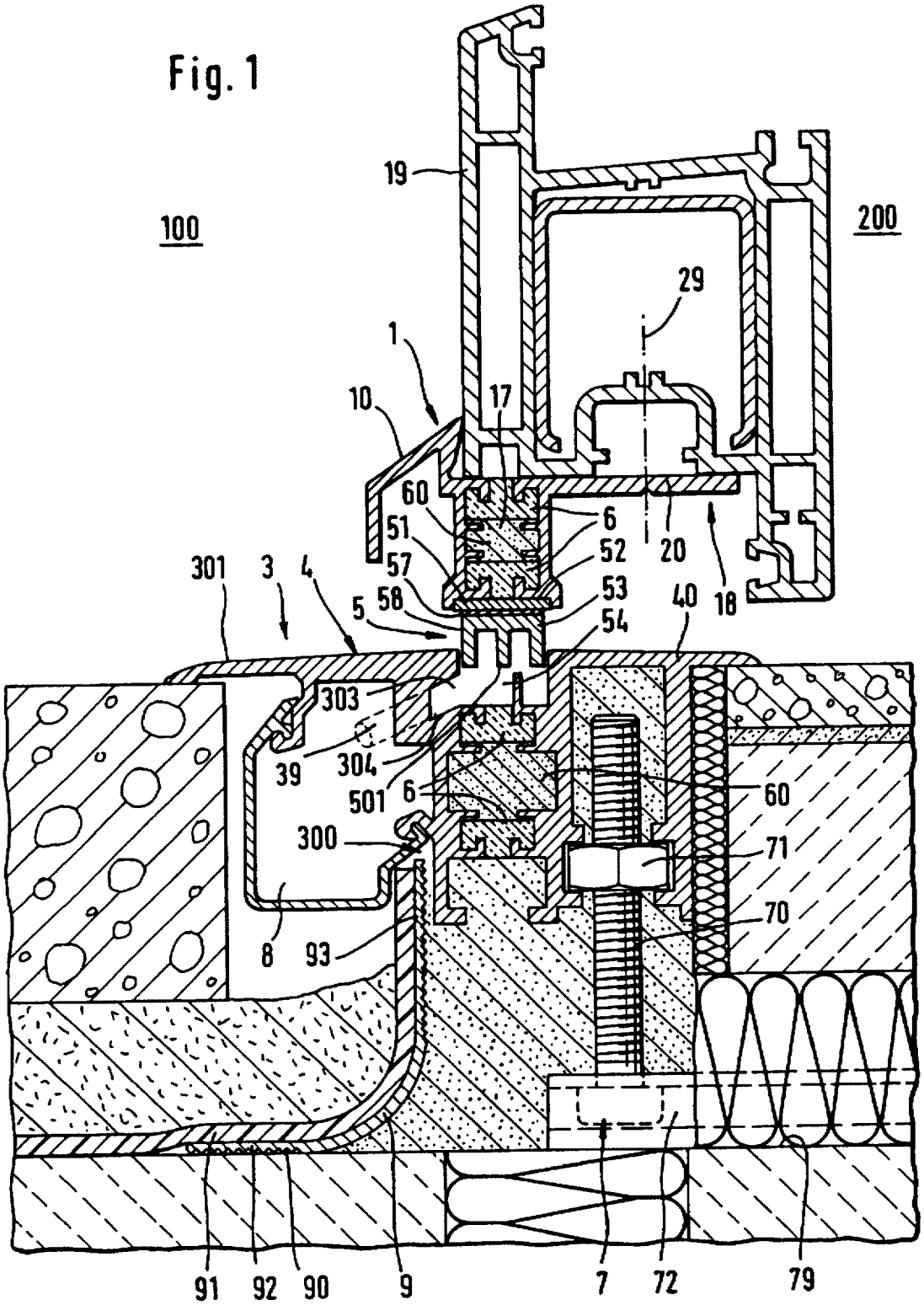
FIG. 1 is a vertical section through a magnetic door seal according to the invention in the fitted state.

Referring first to FIG. 1, a magnetic door seal essentially consists of a first profile 1 which is, for example, fixed to the lower edge 18 of a door. Fixing means is indicated in dot and dash lines by the numeral 29. The first profile 1 carries a magnetic strip 51 in a recess 52 provided on the lower side thereof. This magnetic strip 51 cooperates with a second magnetic strip 53 which is arranged to be vertically movably in a recess 54 of a lower, threshold second profile 3. This second profile 3 is designed as a threshold 4. FIG. 1 shows the door in the closed position, in which the gap 5 between the lower edge 18 of the door and the threshold 4 is sealed by the upwardly extending lower magnetic strip 53.

The second profile 3 is connected to the floor 79 by a height-adjusting means 7. The height-adjusting means 7 here consists of a bolt 70 which is fixed to the floor 79, for example longitudinally slidably in a rail 72, and a nut 71 which is screwed onto the bolt 70 and which is held in the threshold second profile 3 in such a way that it cannot turn.

In order to avoid a thermal bridge at the profiles 1 and 3, it is proposed to divide the profile 1 or the threshold second profile 3.

The first profile 1, which is provided on the lower edge 18 of the door 19, consists of two profile portions 10 (on the outside) and 20 (on the inside). These two profile portions 10 and 20 are rigidly connected to each other by two insulating strips 6. The gap 17 between the two insulating strips 6 is here filled with an insulating foam 60. This insulating foam 60 also provides an increase in stability between the two profile portions 10 and 20.

The outside of the door 19 is designated 100, and the inside 200. Water penetrating into the gap 5, for example driving rain or the like, runs off the outer surface 58 of the magnetic strip 51. Water penetrating into the recess 54 is collected by a water drainage channel 303. This water drainage channel 303 extends over the whole length of the threshold second profile 3. It comprises a groove 304 which is deeper than the bottom of the recess 54 and which receives the water. On the threshold profile 3 there are provided water run-off openings 39 which conduct the water received from the water drainage channel 303 into a water collecting channel 8. The water channel 8 extends also over the length of the profile 3. It is also possible for the whole recess 54 to act as a water drainage channel. The magnetic strip 53 may, for example, define with its outer surface or bottom surface, 58, 501, the water drainage channel.

In the arrangement of the threshold 4 shown in FIG. 1, as smooth and flat a surface 301 as possible is obtained. This is an advantage in particular if this threshold 4 is to be crossed by carriages (for example, shopping trolleys, prams), where a high protruding threshold is a hindrance.

For reliable sealing in the gap 5 the magnetic strip 51, 53 includes a seal 57. The latter can be provided on both the movable and the fixed magnetic strips. It accomplishes reliable sealing of the gap 5 when the door is closed, even if the strips 51, 53 exhibit certain unevenness.

On the outside 100, at the base 300 of the threshold second profile 3 there is provided a cover plate 9. This cover plate 9 is of rounded L-shape. On its two arms 92, 93 it has length-adjusting ribs 90. By means of these ribs 90, the length of the arm 92, 93 can be adjusted as desired by breaking off the arm 92, 93 at these ribs 90. The cover plate 9 has the function of supporting an insulating strip 91, which rests upon it. The insulating strip 91 separates the screed on the inside 200 from the screed on the outside 100. At the same time water running off the insulating strip 91 is drained away to the outside 100 of the threshold 4.

Figure 2:
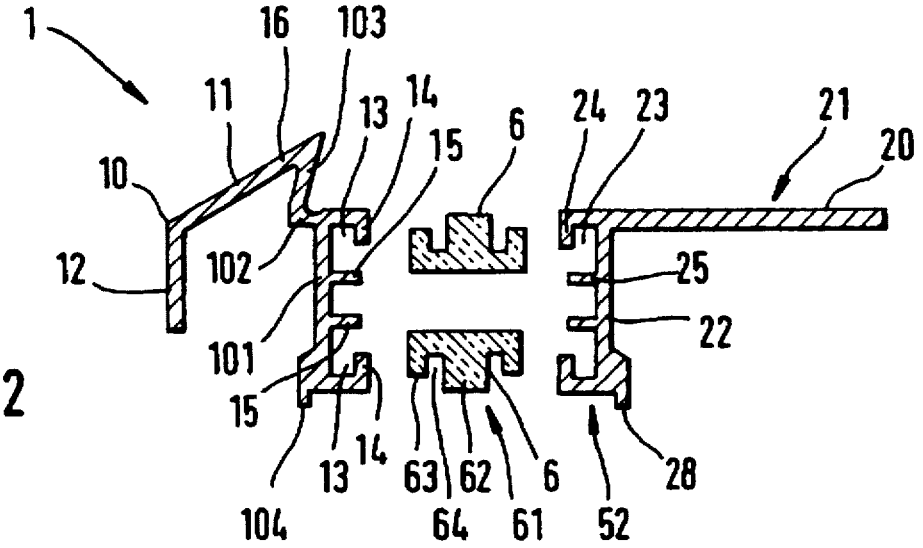
FIG. 2 shows, in vertical section, the elements of the first profile of the door seal according to the invention.

FIG. 2 shows in detail the upper first profile 1 with its components. The outer profile portion 10 is here formed essentially in a U shape 11, wherein a web 16 extends obliquely and with the outer arm of the U forms a weather bar 12. The other arm 101 comprises on the outside several recesses 13, projections 14 and spine strips 15. The U-shaped outer profile 10 is designed in such a way that the arm 101 abutting against the door in the upper region comprises a short, right-angled, inwardly bent portion 102 which is then adjoined by a section 103 which extends further upwards at an acute angle to the vertical and which then at an acute angle adjoins the web 16. By virtue of the section 103 extending at an acute angle, tight abutment of the profile portion 10 against the outside of the door 19 is accomplished.

The insulating strip 6 is essentially E-shaped 61. The two outer arms 63 are of narrower and shorter construction than the centre arm 62. The outer arm 63 encompasses a projection 14 of the profile portion 10 and engages in a recess 13, wherein the rear side of the E-shaped (61) insulating strip 6 in the end region of the E is supported on a spine 15 of the profile portion 10. As a result, the insulating strip 6 is effectively prevented from sliding out of the recess 13. Between the centre arm 62 and the outer arm 63 is located the recess 64 in which the projection 14 engages.

At the lower end of the arm 101 there is provided a wider portion. At the lower end of this wider portion is provided a narrow strip 104 which, with a corresponding strip 28 on the inner profile portion 20, forms the upper recess 52. In the embodiment shown, there is fixed, for example glued, in this recess 52 the magnetic strip 51. The strips 104 and 28 form guides for insertion of the magnetic strip.

The profile portion 20 is essentially L-shaped 21. On the vertically downwardly extending arm 22, on the side inclined towards the outer profile 10, are again provided recesses 23, projections 24 and also spines 25 which, as described above, cooperate with the E-shaped insulating strips 6 so as to engage and hold them together.

The insulating strips 6 can be made, for example, of plastic, rubber or other materials, for example insulating materials, and are either inserted along the profile or pressed into the recesses 13, 23. Filling the gap 17 between the two insulating strips 6 with foam provides an increase in stability and insulation. By this means, both sound and heat insulation are achieved.

Figure 3:
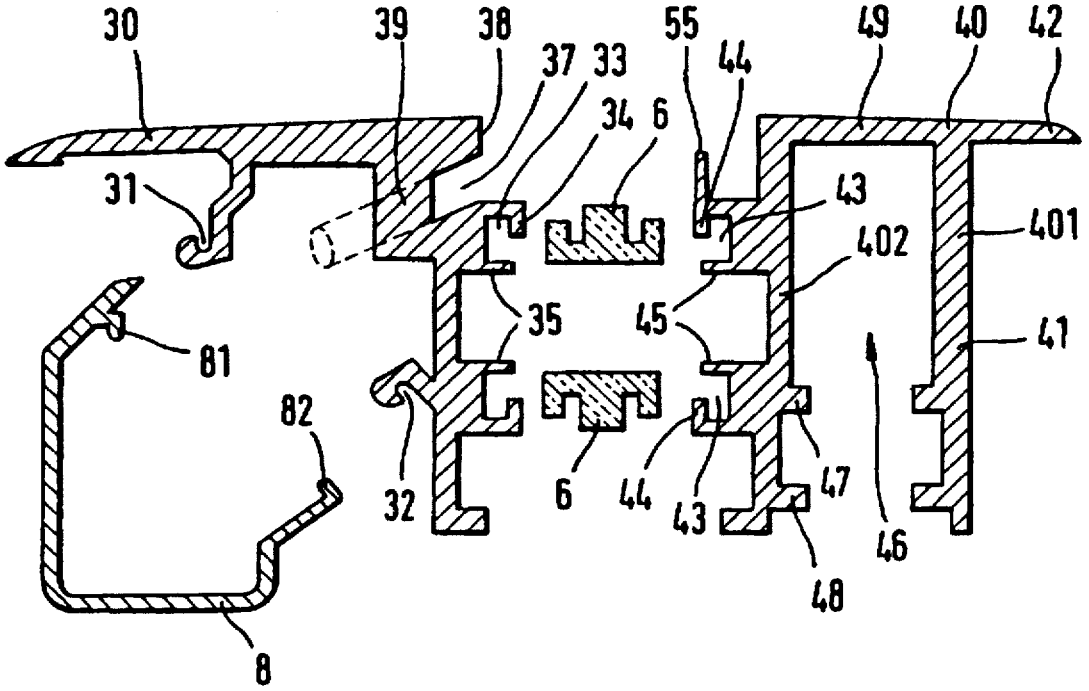
FIG. 3 shows, in vertical section, the elements of the second profile of the magnetic door seal according to the invention.

Between the two profile portions 30, 40 of the threshold second profile 3 are located two insulating strips 6 (see FIG. 3). On the outer profile portion 30 there is provided a water run-off channel 8.

For fixing the insulating strip 6, a recess 33, projections 34 and spines 35 are again provided on the outer profile portion 30. The manner of operation is as described above. These components are located on the essentially vertical web of the L-shaped outer profile portion 30. The projection 34 is again also L-shaped, the essentially horizontal surface forming the bearing surface for the lower magnetic strip 53. The lower magnetic strip 53 lies in the recess 54. The recess 54 is formed by the edge 38 of the L-shaped profile 30 which is set back from the projection 34. Above the projection 34 is shown a water run-off opening 39. A recess 37 is provided in front of this water run-off opening in the profile.

On the webs of the L-shaped outer profile 30 there are provided mounting lugs 31, 32 on which the water run-off channel 8 is mounted. The water run-off channel 8 is made of plastic or aluminium, for example, and exhibits a certain elasticity which allows fixing means 81, 82 on the water run-off channel 8 to be snap-fitted in the mounting lugs 31, 32. It is also possible to glue the water channel in place. The water channel 8 is essentially L-shaped, the fixing means 81, 82 being provided at the ends of the arms of the L on angled portions. In the water run-off channel 8, the water or liquid supplied through the water run-off opening 39 is drained away to the side in the direction of the door jamb.

The profile 40 provided on the inside of the threshold profile is essentially U-shaped 41. A web 49 is adjoined by two essentially similar parallel arms. The web 49 extends inwardly beyond the arm 401 into the strip 42. The strip 42 as well as the end region of the horizontally extending outer profile 30 form an acute angle with the horizontal. On the arm facing towards the other profile 30 are again provided a recess 43, a projection 44 and a spine 45 for connection to an insulating strip 6.

The centre arm 62 of the E-shaped insulating strip 6 is longer than the outer arm 63 such that its surfaces abut flush against the corresponding surfaces on the profiles 30, 40 or 10, 20.

Into an opening 46 formed by the U shape 41 extends the bolt 70 of the height-adjusting means 7. In the lower region of this opening 46 are provided inwardly projecting retaining ribs 47, 48. Between these retaining ribs 47 and 48 is located the nut 71 which is held therein, so that it cannot turn. As a result, adjustment of the height of the threshold 3 can be achieved.

55 denotes a strip in the lower recess 54. This strip 55 improves the sealing action, prevents the penetration of water under wind pressure and provides guidance for the magnetic strip. The strip 55 is for this purpose provided on the inwardly oriented arm 402 of the U-shaped profile 40 on the external side. The downward extension of the strip 55 forms a projection 44 which partially defines a recess 43.

Figure 4:
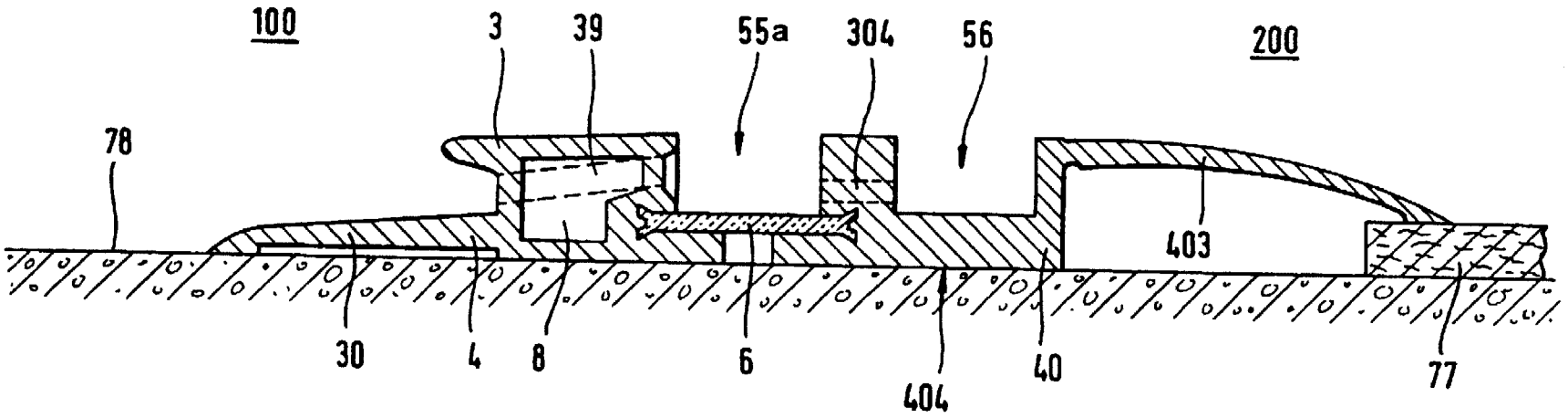
FIG. 4 shows, in vertical section, another embodiment of a magnetic door seal according to the invention.

FIG. 4 shows an embodiment of the magnetic door seal according to the invention which can be fitted in existing doors. In such a case, it is not possible to embed the threshold 4 in the floor or screed. A solution is proposed whereby the threshold 4 or the threshold profile 3 is laid on the existing screed 78, wherein at the same time there being the possibility of equalisation between the outside 100 and inside 200 if, for example, on the inside 200 a floor covering, for example a carpet, is provided on the screed 78.

The profile 3 consists of two portions 30 and 40. It comprises two recesses 55a, 56 which receive magnetic strips. The two profile portions 30 and 40 are connected to each other by an insulating strip 6. The recesses 55a, 56 form water drainage channels. On the front water drainage channel, which is located in the recess 55a, there is provided a water run-off opening 39 which drains away water penetrating into the recess 55a, forwards in the direction of the outside 100. The water run-off opening 39 is connected to a collecting channel 8 which drains the water away to the side. The water run-off opening 39 is also directly connected to the outside, because the water then runs off the threshold 4 to the outside. In this embodiment the recess 56 also has a connection 304 to the recess 55a, so that the accumulated water can be drained away forwards. The profile portion 40 comprises on its inside 200 a slightly inclined arm 403. This arm 403 can be bent so that support and gap-free connection to the floor 77 is possible. The profile is, for example, also made of aluminium. It is also possible to make the profile in one piece. For resting of the profile on the floor, the threshold has a bearing surface 404 which is as straight as possible.

Figure 5:
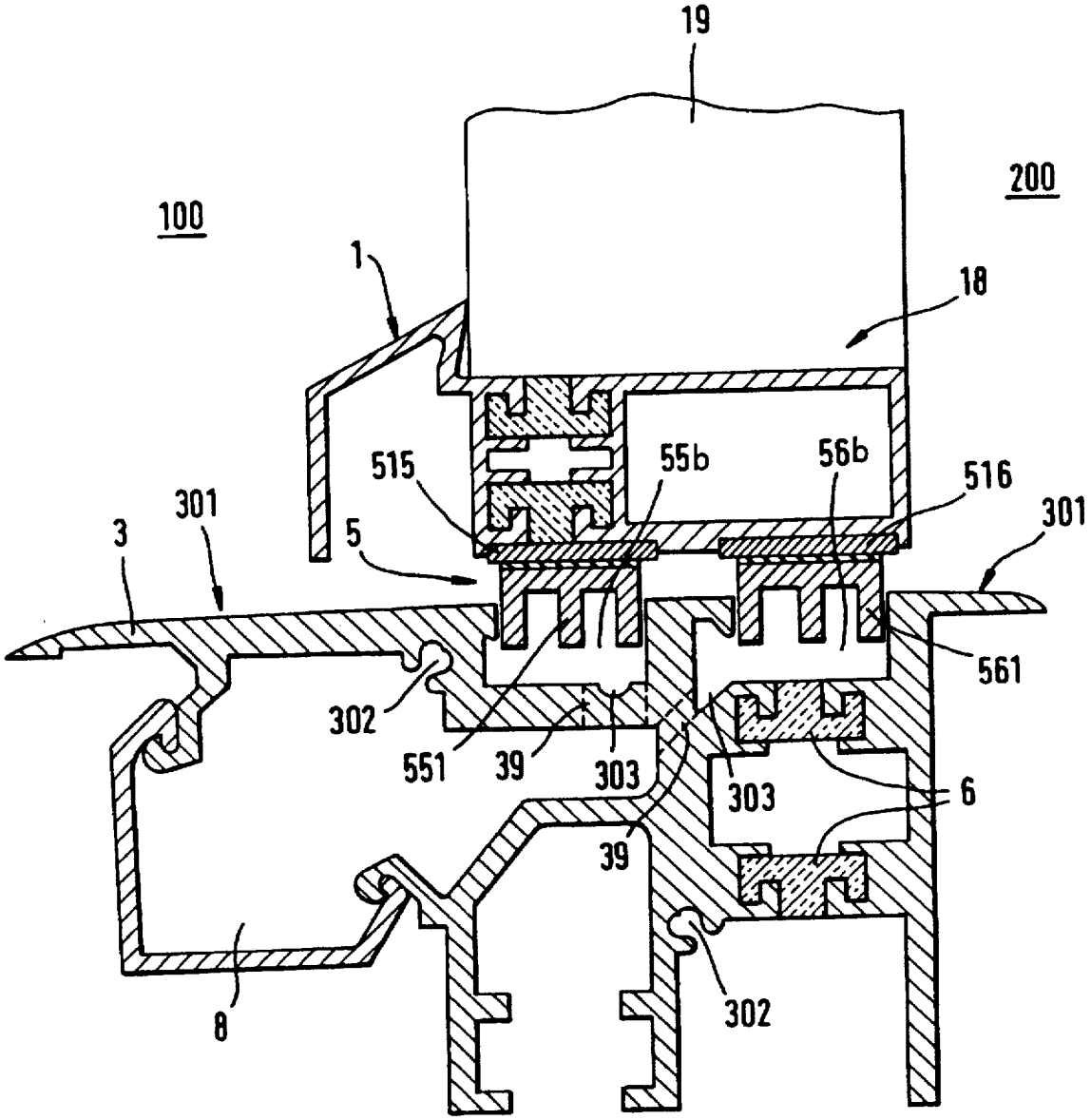
FIG. 5 shows, in vertical section, another embodiment of a magnetic door seal according to the invention.

In the embodiment shown in FIG. 5, the gap 5 is sealed by two magnetic strips 551, 561 which are arranged one behind the other. The profile 3 may be constructed in one, two or more portions. The different portions are held together by insulating strips 6. The magnetic strips 551 and 561 arranged one behind the other are located in recesses 55b and 56b. In this embodiment the magnetic strips 551 and 561 are designed to be movable, and the magnetic strips 515 and 516 provided on the lower edge 18 of the door are fixed. It is also possible to provide the reverse arrangement. In the two recesses 55b, 56b there are provided water drainage channels 303. These water drainage channels 303 are located, for example, below the magnetic strip (in recess 55b) or adjacent to the magnetic strip (in recess 56b). The water drainage channels 303 each comprise water run-off openings 39 through which the penetrating water is drained into a collecting channel 8 which is provided on the outside 100.

For fixing the threshold 3, in particular when this consists of several portions, the profile portions 30, 40 have a plurality of screw channels 302 into which can be screwed screws which connect the threshold 3 to the inner face of the door jamb or the like.

Figure 6:
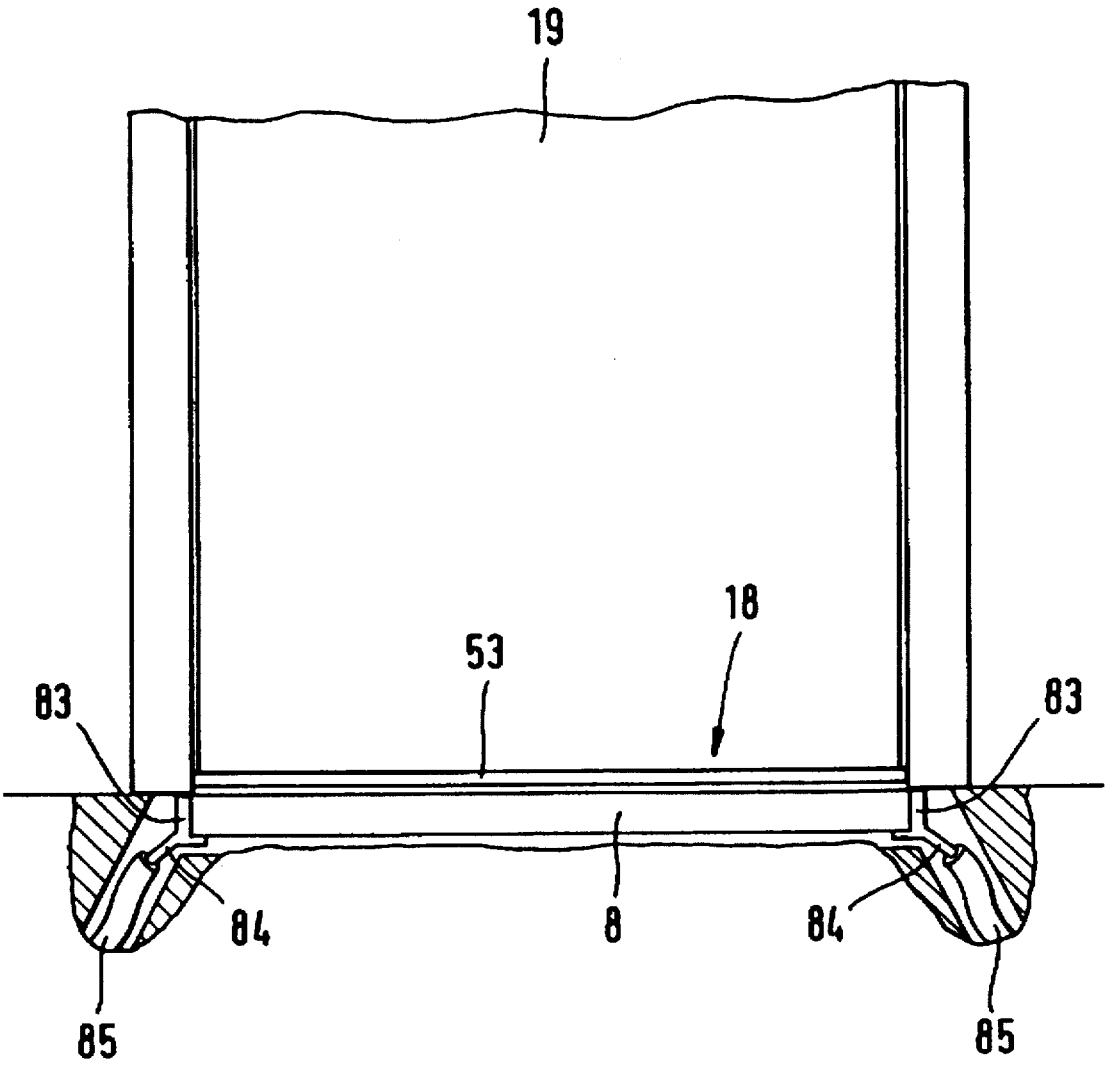
FIG. 6 shows, a front view of a magnetic door seal according to the invention in the fitted state with partial sections at the side.

The water contained in the collecting channel 8 is drained away on the side adjacent to the door 19 (see FIG. 6). For this purpose, a channel-encompassing cover 83 is provided at the ends of the channel 8. This cover 83 comprises a downwardly projecting connection piece 84 which is connected to a hose 85. The end of the hose 85 can now be laid in regions of the foundation, so that the water is reliably conducted away from the threshold 4.

What is claimed is:

1. Magnetic door seal for use in association with a door mounted above a threshold, said magnetic door seal comprising a first profile for mounting on a lower edge of the door, a first magnetic strip provided in said first profile, a second profile for mounting on the threshold, and a second magnetic strip provided in said second profile, said first and second magnetic strips cooperating magnetically to seal a gap between the lower edge of the door and the threshold when the door is closed, and said second magnetic strip being movable up into contact with said first magnetic strip and acting as a sealing strip, an exterior surface of said second magnetic strip at least partially defining a water drainage channel extending parallel to said second magnetic strip, a recess located in said second profile, said second magnetic strip being movable from and housed in said recess when the door is open, said recess serving as a remainder of said water drainage channel, water run-off openings provided in a bottom of said recess, and a collecting channel extending along said second profile until opening at lateral edges for release of water from opposed ends of said collecting channel, said water run-off openings extending from said bottom of said recess into said collecting channel.

2. Magnetic door seal according to claim 1, wherein said second profile is provided with two parallel recesses, one of which receives said second magnetic strip and the other of which receives a further magnetic strip, and each of which form water drainage channels with water run-off openings which lead to a collecting channel.

3. Magnetic door seal according to claim 1, wherein said collecting channel has lateral covers through which water collected in said collecting channel is drained to the outside of the threshold.

4. Magnetic door seal according to claim 1, wherein said second profile has a flat upper surface.

5. Magnetic door seal according to claim 1, wherein at least one of said first profile and said second profile are constructed in first and second profile portions and said first and second profile portions are held together by an insulating strip, and the first and second profile portions together define a recess which receives said first or second magnetic strip.

6. Magnetic door seal according to claim 1, wherein on the outside of said second profile there is provided an L-shaped cover place which is provided with length-adjusting ribs and which supports an insulating strip.

7. Magnetic door seal according to claim 1, wherein said second profile rests on a floor.

8. Magnetic door seal according to claim 1, wherein at least one of the first and second magnetic strip is provided with a seal which seals the contact between said first and second magnetic strips.

9. Magnetic door seal according to claim 1, wherein said second profile is provided with longitudinally extending screw channels for fixing said second profile to the door jamb.

10. Magnetic door seal for use in association with a door mounted above a threshold, said magnetic door seal comprising a first profile for mounting on a lower edge of the door, a first magnetic strip provided in said first profile, a second profile for mounting on the threshold, and a second magnetic strip provided in said second profile, said first and second magnetic strips cooperating magnetically for sealing a gap between the lower edge of the door and the threshold when the door is closed, and one of said first and second magnetic strips being movable and acting as a sealing strip, said second magnetic strip at least partially defining a water drainage channel extending parallel to said second magnetic strip, at least one of said first profile and said second profile being constructed in first and second profile portions and said first and second profile portions being held together by an insulating strip and the other of which receives a further magnetic strip, and the first and second profile portions together define a recess which receives said first or second magnetic strip.

11. Magnetic door seal according to claim 10, wherein said first magnetic strip is fixed and said second magnetic strip is movable.

12. Magnetic door seal according to claim 10, wherein said second profile is provided with two parallel recesses, one of which receives said second magnetic strip and the other of which receives a further magnetic strip, and each of which form water drainage channels with water run-off openings which lead to a collecting channel.

13. Magnetic door seal according to claim 10, wherein at least one of the first and second magnetic strip is provided with a seal which seals the contact between said first and second magnetic strips.

14. Magnetic door seal for use in association with a door mounted above a threshold, said magnetic door seal comprising a first profile for mounting on a lower edge of the door, a first magnetic strip provided in said first profile, a second profile for mounting on the threshold, a second magnetic strip provided in said second profile, said first and second magnetic strips cooperating magnetically for sealing a gap between the lower edge of the door and the threshold when the door is closed, and one of said first and second magnetic strips being movable and acting as a sealing strip, said second magnetic strip at least partially defining a water drainage channel extending parallel to said second magnetic strip, and an L-shaped cover plate on the outside of said second profile provided with length-adjusting ribs and which supports an insulating strip.

15. Magnetic door seal according to claim 14, wherein said first magnetic strip is fixed and said second magnetic strip is movable.

16. Magnetic door seal according to claim 14, wherein said second profile is provided with two parallel recesses, one of which receives said second magnetic strip and the other of which receives a further magnetic strip, and each of which form water drainage channels with water run-off openings which lead to a collecting channel.

17. Magnetic door seal according to claim 14, wherein at least one of the first and second magnetic strip is provided with a seal which seals the contact between said first and second magnetic strips.

* * * * *